US008231740B2

(12) United States Patent
Nakamura et al.

(10) Patent No.: US 8,231,740 B2
(45) **Date of Patent: *Jul. 31, 2012**

(54) METHOD FOR PREPARING RARE EARTH PERMANENT MAGNET MATERIAL

(75) Inventors: Hajime Nakamura, Echizen (JP); Takehisa Minowa, Echizen (JP); Koichi Hirota, Echizen (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 696 days.

This patent is subject to a terminal disclaimer.

(21) Appl. No.: 11/783,782

(22) Filed: Apr. 12, 2007

(65) Prior Publication Data

US 2007/0240789 A1 Oct. 18, 2007

(30) Foreign Application Priority Data

Apr. 14, 2006 (JP) ..... 2006-112382

(51) Int. Cl.
*H01F 1/057* (2006.01)

(52) U.S. Cl. ..... 148/122; 148/302; 148/101

(58) Field of Classification Search ..... None
See application file for complete search history.

(56) References Cited

U.S. PATENT DOCUMENTS

| | | | | |
|---|---|---|---|---|
| 4,837,114 | A | 6/1989 | Hamada et al. | |
| 4,917,778 | A | 4/1990 | Takada et al. | |
| 4,942,098 | A * | 7/1990 | Hamamura et al. | 428/555 |
| 4,968,529 | A * | 11/1990 | Hamamura et al. | 427/131 |
| 4,981,532 | A | 1/1991 | Takeshita et al. | |
| 5,034,146 | A | 7/1991 | Ohashi et al. | |
| 5,194,099 | A | 3/1993 | Esper et al. | |
| 5,316,595 | A * | 5/1994 | Hamada et al. | 148/302 |
| 5,405,455 | A | 4/1995 | Kusunoki et al. | |
| 5,411,603 | A | 5/1995 | Vial et al. | |
| 5,580,396 | A | 12/1996 | Fruchart et al. | |
| 5,766,372 | A | 6/1998 | Fujimura et al. | |
| 5,851,312 | A | 12/1998 | Honkura et al. | |
| 5,858,123 | A | 1/1999 | Uchida et al. | |
| 5,858,124 | A | 1/1999 | Endo et al. | |
| 6,296,720 | B1 | 10/2001 | Yamamoto et al. | |
| 6,302,939 | B1 | 10/2001 | Rabin et al. | |
| 6,403,024 | B1 | 6/2002 | Oota et al. | |
| 6,606,019 | B1 | 8/2003 | Ohashi | |
| 6,960,240 | B2 | 11/2005 | Hirota et al. | |
| 7,053,745 | B2 | 5/2006 | Yoshimura et al. | |
| 7,485,193 | B2 | 2/2009 | Hirota et al. | |
| 7,559,996 | B2 | 7/2009 | Miyata et al. | |
| 2003/0047240 | A1 | 3/2003 | Honkura et al. | |
| 2003/0079805 | A1 | 5/2003 | Hamada et al. | |
| 2004/0000359 | A1 | 1/2004 | Tayu et al. | |
| 2004/0187970 | A1 | 9/2004 | Ishizaka et al. | |
| 2006/0213582 | A1 | 9/2006 | Nakamura et al. | |
| 2006/0213583 | A1 | 9/2006 | Nakamura et al. | |
| 2006/0213584 | A1 | 9/2006 | Nakamura et al. | |
| 2006/0213585 | A1 | 9/2006 | Nakamura et al. | |
| 2006/0278517 | A1 | 12/2006 | Machida et al. | |
| 2007/0017601 | A1 | 1/2007 | Miyata et al. | |
| 2007/0034299 | A1 * | 2/2007 | Machida et al. | 148/105 |
| 2007/0160863 | A1 | 7/2007 | Hamada et al. | |
| 2007/0240787 | A1 | 10/2007 | Nakamura et al. | |
| 2007/0240788 | A1 | 10/2007 | Nakamura et al. | |
| 2007/0240789 | A1 | 10/2007 | Nakamura et al. | |
| 2008/0054736 | A1 | 3/2008 | Miyata et al. | |
| 2008/0223489 | A1 * | 9/2008 | Nagata et al. | 148/101 |
| 2008/0245442 | A1 | 10/2008 | Nakamura et al. | |
| 2008/0247896 | A1 | 10/2008 | Cooper et al. | |
| 2008/0247898 | A1 | 10/2008 | Nakamura et al. | |
| 2009/0020193 | A1 * | 1/2009 | Ohta et al. | 148/559 |
| 2009/0098006 | A1 | 4/2009 | Nakamura et al. | |
| 2009/0226339 | A1 | 9/2009 | Nakamura et al. | |
| 2011/0000586 | A1 * | 1/2011 | Nomura et al. | 148/514 |
| 2011/0036457 | A1 * | 2/2011 | Nagata et al. | 148/101 |

FOREIGN PATENT DOCUMENTS

| | | | |
|---|---|---|---|
| EP | 0 255 939 | A2 | 2/1988 |
| EP | 0 345 092 | A1 | 12/1989 |
| EP | 0 633 581 | A1 | 1/1995 |
| EP | 1 267 365 | A2 | 12/2002 |
| EP | 1643513 | A1 | 5/2006 |
| EP | 1 705 668 | A2 | 9/2006 |
| EP | 1 705 669 | A2 | 9/2006 |
| EP | 1 705 670 | A2 | 9/2006 |
| EP | 1 705 671 | A2 | 9/2006 |
| EP | 1 734 539 | A1 | 12/2006 |
| EP | 1 746 611 | A1 | 1/2007 |
| EP | 1 830 371 | A1 | 9/2007 |
| JP | 61-195954 | A | 8/1986 |
| JP | 52-192566 | * | 8/1987 |
| JP | 62-192566 | A | 8/1987 |

(Continued)

OTHER PUBLICATIONS

Stanley, James K., "Metallurgy and Magnetism", 1949, pp. 119-120.*

Rolfe, R. T., "A Dictionary of Metallography", 1955, p. 5.*

"The Great Soviet Encyclopedia", 1979, (form thefreedictionary.com).*

K.D. Durst et al., "The Coercive Field of Sintered and Melt-Spun NdFeB Magnets", Journal of Magnetism and Magnetic Materials, vol. 68, (1987), pp. 63-75.

K.T. Park et al., "Effect of Metal-Coating and Consecutive Heat Treatment on Coercivity of Thin Nd-Fe-B Sintered Magnets", Proceedings of the Sixteenth International Workshop on Rare-Earth Magnets and Their Applications, Sendai, (2000), pp. 257-264.

(Continued)

*Primary Examiner* — John Sheehan

(74) *Attorney, Agent, or Firm* — Westerman, Hattori, Daniels & Adrian, LLP

(57) ABSTRACT

A rare earth permanent magnet material is prepared by covering a sintered magnet body of $R^1$—Fe—B composition wherein $R^1$ is a rare earth element, with a powder comprising at least 30% by weight of an alloy of $R^2{}_aT_bM_cA_dH_e$ wherein $R^2$ is a rare earth element, T is Fe and/or Co, and M is Al, Cu or the like, and having an average particle size up to 100 μm, and heat treating the powder-covered magnet body at a suitable temperature, for causing $R^2$, T, M and A in the powder to be absorbed in the magnet body.

20 Claims, No Drawings

FOREIGN PATENT DOCUMENTS

| | | | |
|---|---|---|---|
| JP | 62-256412 | A | 11/1987 |
| JP | 1-117303 | A | 5/1989 |
| JP | 1-155603 | A | 6/1989 |
| JP | 1-251704 | A | 10/1989 |
| JP | 3-188241 | A | 8/1991 |
| JP | 4-184901 | A | 7/1992 |
| JP | 4-328204 | A | 11/1992 |
| JP | 4-328804 | A | 11/1992 |
| JP | 5-21218 | A | 1/1993 |
| JP | 5-021218 | A | 1/1993 |
| JP | 5-31807 | B2 | 5/1993 |
| JP | 6-158238 | A | 6/1994 |
| JP | 6-244011 | A | 9/1994 |
| JP | 3143156 | B2 | 3/2001 |
| JP | 2003-282312 | A | 10/2003 |
| JP | 3471876 | B2 | 12/2003 |
| JP | 2004-281492 | A | 10/2004 |
| JP | 2004-281493 | A | 10/2004 |
| JP | 2004-296973 | A | 10/2004 |
| JP | 2004-304038 | A | 10/2004 |
| JP | 2005-011973 | A | 1/2005 |
| JP | 2005-285861 | A | 10/2005 |
| JP | 2006-049865 | A | 2/2006 |
| JP | 2007-053351 | A | 3/2007 |
| SU | 1 513 738 | A1 | 4/1995 |
| WO | 2004-114333 | A1 | 12/2004 |
| WO | 2005-123974 | A1 | 12/2005 |
| WO | 2006-003882 | A1 | 1/2006 |
| WO | 2006-043348 | A1 | 4/2006 |
| WO | WO 2006/043348 | A1 | 4/2006 |
| WO | WO 2006/112403 | * | 10/2006 |
| WO | 2007-119551 | A1 | 10/2007 |

OTHER PUBLICATIONS

European Search Report dated Jun. 4, 2008, issued in corresponding European Patent Application No. 07251603.2.
"Shin-Etsu Chemical, develops new high-performance technology for neodymium rare-earth magnets", Shin-Etsu News, press release in Tokyo, Mar. 24, 2005.
U.S. Appl. No. 11/916,498, filed Dec. 4, 2007 entitled Method for Preparing Rare Earth Permanent Magnet Material.
The Journal of the Institute of Electrical Engineers of Japan, vol. 124, 2004, pp. 699-702, published on Nov. 1, 2004.
Press Release (Shin-Etsu News) dated on Mar. 24, 2005.
Intermag Asia 2005; Digest of the IEEE International Magnetics Conference; p. 476; held on Apr. 4-8, 2005.
Techno-Frontier Symposium 2005; pp. B1-2-1 to B1-2-12; held on Apr. 20, 2005 by JMA.
IEEE Transactions on Magnetics, vol. 41, No. 10. Oct. 2005, pp. 3844-3846.
Abstract of Autumn Meeting of Japan Society of Powder and Powder Metallurgy, 2005; p. 143; held on Nov. 14-16, 2005.
2005 BM Symposium, Abstract of Presentation by The Japan Association of Bonded Magnet Industries held on Dec. 2, 2005.
Hajime Nakamura, "Nd-Fe-B Sintered Magnets Produced by the Grain Boundary Diffusion Process", Bulletin of Topical Symposium of the Magnetic Society of Japan, Mar. 14, 2006, pp. 13-18.
IEEE International Magnetics Conference, May 8-12, 2006, p. 910.
Digest of the 30$^{th}$ Annual Conference on Magnetics in Japan 2006, pp. 417-418.
The Nikkan Kogyo Shimbun, reporting the press release, Mar. 25, 2005.
The Dempa Shimbun, reporting the press release, Mar. 25, 2005.
The Kagaku Kogyo Nippo, reporting the press release, Mar. 25, 2005.
The Sekiyu Kagaku Shimbun Nikkan Tsushin, reporting the press release, Mar. 25, 2005.
The Nikkan Chemical News, reporting the press release, Mar. 25, 2005.
Nikkei Net, reporting the press release, Mar. 25, 2005.
Kenichi Machida et al., "Grain Boundary Modification and Magnetic Properties of Nd-Fe-B Sintered Magnets", Abstracts of Spring Meeting of Japan Society of Powder and Powder Metallurgy, 2004, pp. 202.
Hajime Nakamura, et al., "Microstructures of the anisotropic Nd-Fe-B HDDR treated powder," The Papers of Technical Meeting on Magnetics, Nov. 17, 1998, pp. 31-36, Technical Meeting on Magnetics, The Institute of Electrical Engineers of Japan.
Nakamura, Hajime, "Nd-Fe-B Based Sintered Magnet Processed to Ultraminiature Size", The Journal of the Institute of Electrical Engineers of Japan, Nov. 1, 2004, p. 699-702, vol. 124 No. 11.
International Search Report of PCT/JP2007/056594, date of mailing Jul. 10, 2007.
International Search Report of PCT/JP2007/056586, date of mailing Jun. 19, 2007.
European Search Report dated Jun. 26, 2008, issued in corresponding European Patent Application No. 08250927.4.
Qin, C-D et al., "The protective coatings of NdFeB magnets by Al and Al(Fe)", Journal of Applied Physics, Apr. 15, 1996, pp. 4854-4856, vol. 79 No. 8.
Russian Decision on Grant dated Mar. 18, 2009, issued in corresponding Russian patent application No. 2006 117529/02.
Extended European Search Report dated Jan. 14, 2008 for European Application No. 06250542.5.
Translation of International Preliminary Report on Patentability mailed May 3, 2007 of International Application No. PCT/JP2005/005134.
International Search Report of PCT/JP2005/005134, Mailing Date of Jul. 12, 2005.
European Search Report dated May 28, 2008, issued in corresponding European Patent Application No. 07251607.3.
Kim, A. S. et al., "Development of High Coercive Powder From the Nd-Fe-B Sintered Magnet Scrap", IEEE Transactions on Magnetics, Jul. 2004, p. 2877-2879, vol. 40 No. 4.
Hirota, K. et al., "Coercivity Enhancement by the Grain Boundary Diffusion Process to Nd-Fe-B Sintered Magnets", IEEE Transactions on Magnetics, Oct. 2006, p. 2909-2911, vol. 42 No. 10.
Extended European Search Report, issued Mar. 31, 2008 for corresponding European Patent Application No. 07254503.1.
Supplemental European Search Report, issued Mar. 22, 2010 for corresponding European Patent Application No. 07740024.0.

* cited by examiner

METHOD FOR PREPARING RARE EARTH PERMANENT MAGNET MATERIAL

CROSS-REFERENCE TO RELATED APPLICATION

This non-provisional application claims priority under 35 U.S.C. §119(a) on Patent Application No. 2006-112382 filed in Japan on Apr. 14, 2006, the entire contents of which are hereby incorporated by reference.

TECHNICAL FIELD

This invention relates to a method for preparing an R—Fe—B permanent magnet material so that its coercive force is enhanced while minimizing a decline of its remanence.

BACKGROUND ART

By virtue of excellent magnetic properties, Nd—Fe—B permanent magnets find an ever increasing range of application. The recent challenge to the environmental problem has expanded the application range of magnets to industrial equipment, electronic automobiles and wind power generators. It is required to further improve the performance of Nd—Fe—B magnets.

Indexes for the performance of magnets include remanence (or residual magnetic flux density) and coercive force. An increase in the remanence of Nd—Fe—B sintered magnets can be achieved by increasing the volume factor of $Nd_2Fe_{14}B$ compound and improving the crystal orientation. To this end, a number of modifications have been made on the process. For increasing coercive force, there are known different approaches including grain refinement, the use of alloy compositions with greater Nd contents, and the addition of effective elements. The currently most common approach is to use alloy compositions having Dy or Tb substituted for part of Nd. Substituting these elements for Nd in the $Nd_2Fe_{14}B$ compound increases both the anisotropic magnetic field and the coercive force of the compound. The substitution with Dy or Tb, on the other hand, reduces the saturation magnetic polarization of the compound. Therefore, as long as the above approach is taken to increase coercive force, a loss of remanence is unavoidable. Since Tb and Dy are expensive metals, it is desired to minimize their addition amount.

In Nd—Fe—B magnets, the coercive force is given by the magnitude of an external magnetic field which creates nuclei of reverse magnetic domains at grain boundaries. Formation of nuclei of reverse magnetic domains is largely dictated by the structure of the grain boundary in such a manner that any disorder of grain structure in proximity to the boundary invites a disturbance of magnetic structure or a decline of magneto-crystalline anisotropy, helping formation of reverse magnetic domains. It is generally believed that a magnetic structure extending from the grain boundary to a depth of about 5 nm contributes to an increase of coercive force, that is, the magneto-crystalline anisotropy is reduced in this region. It is difficult to acquire a morphology effective for increasing coercive force.

The references include JP-B 5-31807, JP-A 5-21218, K. D. Durst and H. Kronmuller, "THE COERCIVE FIELD OF SINTERED AND MELT-SPUN NdFeB MAGNETS," Journal of Magnetism and Magnetic Materials, 68 (1987), 63-75, K. T. Park, K. Hiraga and M. Sagawa, "Effect of Metal-Coating and Consecutive Heat Treatment on Coercivity of Thin Nd—Fe—B Sintered Magnets," Proceedings of the Sixteen International Workshop on Rare-Earth Magnets and Their Applications, Sendai, p. 257 (2000), and K. Machida, H. Kawasaki, M. Ito and T. Horikawa, "Grain Boundary Tailoring of Nd—Fe—B Sintered Magnets and Their Magnetic Properties," Proceedings of the 2004 Spring Meeting of the Powder & Powder Metallurgy Society, p. 202.

DISCLOSURE OF THE INVENTION

An object of the invention is to provide a method for preparing a rare earth permanent magnet in the form of R—Fe—B sintered magnet wherein R is two or more elements selected from rare earth elements inclusive of Sc and Y, the magnet exhibiting high performance despite a minimized content of Tb or Dy.

The inventors have discovered that when a $R^1$—Fe—B sintered magnet (wherein $R^1$ is at least one element selected from rare earth elements inclusive of Sc and Y), typically a Nd—Fe—B sintered magnet, with a rare earth-rich alloy powder which becomes a liquid phase at the treating temperature being disposed on a surface thereof, is heated at a temperature below the sintering temperature, $R^2$ contained in the powder is effectively absorbed in the magnet body so that $R^2$ is concentrated only in proximity to grain boundaries for modifying the structure in proximity to the grain boundaries to restore or enhance magneto-crystalline anisotropy whereby the coercive force is increased while suppressing a decline of remanence.

The invention provides a method for preparing a rare earth permanent magnet material, comprising the steps of:

disposing a powder on a surface of a sintered magnet body of $R^1$—Fe—B composition wherein $R^1$ is at least one element selected from rare earth elements inclusive of Sc and Y, said powder comprising at least 30% by weight of an alloy of $R^2{}_aT_bM_cA_dH_e$ wherein $R^2$ is at least one element selected from rare earth elements inclusive of Sc and Y, T is iron and/or cobalt, M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, A is boron and/or carbon, H is hydrogen, and "a" to "e" indicative of atomic percentages based on the alloy are in the range: $15 \leqq a \leqq 80$, $0.1 \leqq c \leqq 15$, $0 \leqq d \leqq 30$, $0 \leqq e \leqq (a \times 2.5)$, and the balance of b, and said powder having an average particle size equal to or less than 100 μm, and heat treating the magnet body having the powder disposed on its surface at a temperature equal to or below the sintering temperature of the magnet body in vacuum or in an inert gas, for absorption treatment for causing $R^2$ and at least one of T, M and A in the powder to be absorbed in the magnet body.

In a preferred embodiment, the sintered magnet body has a minimum portion with a dimension equal to or less than 20 mm.

In a preferred embodiment, the powder is disposed on the magnet body surface in an amount corresponding to an average filling factor of at least 10% by volume in a magnet body-surrounding space at a distance equal to or less than 1 mm from the magnet body surface.

In a preferred embodiment, the powder contains at least 1% by weight of at least one of an oxide of $R^3$, a fluoride of $R^4$, and an oxyfluoride of $R^5$ wherein each of $R^3$, $R^4$, and $R^5$ is at least one element selected from rare earth elements inclusive of Sc and Y, so that at least one of $R^3$, $R^4$, and $R^5$ is absorbed in the magnet body. Preferably, each of $R^3$, $R^4$, and $R^5$ contains at least 10 atom % of at least one element selected from Nd, Pr, Dy, and Tb.

In a preferred embodiment, $R^2$ contains at least 10 atom % of at least one element selected from Nd, Pr, Dy, and Tb. In a preferred embodiment, the disposing step includes feeding the powder as a slurry dispersed in an aqueous or organic solvent.

The method may further comprise, after the absorption treatment, the step of effecting aging treatment at a lower temperature. The method may further comprise, prior to the disposing step, the step of washing the magnet body with at least one agent selected from alkalis, acids, and organic solvents. The method may further comprise, prior to the disposing step, the step of shot blasting the magnet body for removing a surface layer. The method may further comprise the step of washing the magnet body with at least one agent selected from alkalis, acids, and organic solvents after the absorption treatment or after the aging treatment. The method may further comprise the step of machining the magnet body after the absorption treatment or after the aging treatment. The method may further comprise the step of plating or coating the magnet body, after the absorption treatment, after the aging treatment, after the alkali, acid or organic solvent washing step following the aging treatment, or after the machining step following the aging treatment.

BENEFITS OF THE INVENTION

The rare earth permanent magnet materials in the form of R—Fe—B sintered magnets according to the invention exhibit high performance despite a minimized content of Tb or Dy.

DESCRIPTION OF THE PREFERRED EMBODIMENTS

The invention pertains to an R—Fe—B sintered magnet material exhibiting high performance and having a minimized content of Tb or Dy.

The invention starts with an $R^1$—Fe—B sintered magnet body which is obtainable from a mother alloy by a standard procedure including crushing, fine pulverization, compaction and sintering.

As used herein, R and $R^1$ are selected from rare earth elements inclusive of Sc and Y. R is mainly used for the finished magnet body while $R^1$ is mainly used for the starting material.

The mother alloy contains $R^1$, T, A and optionally E. $R^1$ is at least one element selected from rare earth elements inclusive of Sc and Y, specifically from among Sc, Y, La, Ce, Pr, Nd, Sm, Eu, Gd, Tb, Dy, Ho, Er, Yb, and Lu, with Nd, Pr and Dy being preferably predominant. It is preferred that rare earth elements inclusive of Sc and Y account for 10 to 15 atom %, more preferably 12 to 15 atom % of the overall alloy. Desirably $R^1$ contains at least 10 atom %, especially at least 50 atom % of Nd and/or Pr based on the entire $R^1$. T is iron (Fe) and/or cobalt (Co). The content of Fe is preferably at least 50 atom %, especially at least 65 atom % of the overall alloy. A is boron (B) and/or carbon (C). It is preferred that boron accounts for 2 to 15 atom %, more preferably 3 to 8 atom % of the overall alloy. E is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, and may be contained in an amount of 0 to 11 atom %, especially 0.1 to 5 atom % of the overall alloy. The balance consists of incidental impurities such as nitrogen (N), oxygen (0) and hydrogen (H), and their total is generally equal to or less than 4 atom %.

The mother alloy is prepared by melting metal or alloy feeds in vacuum or an inert gas atmosphere, preferably argon atmosphere, and casting the melt into a flat mold or book mold or strip casting. A possible alternative is a so-called two-alloy process involving separately preparing an alloy approximate to the $R^1{}_2Fe_{14}B$ compound composition constituting the primary phase of the relevant alloy and a rare earth-rich alloy serving as a liquid phase aid at the sintering temperature, crushing, then weighing and mixing them. Notably, the alloy approximate to the primary phase composition is subjected to homogenizing treatment, if necessary, for the purpose of increasing the amount of the $R^1{}_2Fe_{14}B$ compound phase, since primary crystal α-Fe is likely to be left depending on the cooling rate during casting and the alloy composition. The homogenizing treatment is a heat treatment at 700 to 1,200° C. for at least one hour in vacuum or in an Ar atmosphere. To the rare earth-rich alloy serving as a liquid phase aid, the melt quenching and strip casting techniques are applicable as well as the above-described casting technique.

The alloy is generally crushed to a size of 0.05 to 3 mm, especially 0.05 to 1.5 mm. The crushing step uses a Brown mill or hydriding pulverization, with the hydriding pulverization being preferred for those alloys as strip cast. The coarse powder is then finely divided to a size of 0.2 to 30 μm, especially 0.5 to 20 μm, for example, by a jet mill using nitrogen under pressure.

The fine powder is compacted on a compression molding machine while being oriented under a magnetic field. The green compact is placed in a sintering furnace where it is sintered in vacuum or in an inert gas atmosphere usually at a temperature of 900 to 1,250° C., preferably 1,000 to 1,100° C. The sintered magnet thus obtained contains 60 to 99% by volume, preferably 80 to 98% by volume of the tetragonal $R^1{}_2Fe_{14}B$ compound as the primary phase, with the balance being 0.5 to 20% by volume of a rare earth-rich phase, 0 to 10% by volume of a B-rich phase, and 0.1 to 10% by volume of at least one of rare earth oxides, and carbides, nitrides and hydroxides resulting from incidental impurities, or a mixture or composite thereof.

The sintered block is then machined into a predetermined shape. It is noted that M and/or $R^2$ to be absorbed in the magnet body according to the invention is fed from the magnet body surface wherein $R^2$ is at least one element selected from rare earth elements inclusive of Sc and Y, specifically from among Sc, Y, La, Ce, Pr, Nd, Sm, Eu, Gd, Tb, Dy, Ho, Er, Yb, and Lu, with Nd, Pr and Dy being preferably predominant. If the magnet body is too large in dimensions, the objects of the invention are not achievable. Then, the sintered block is preferably machined to a shape having a minimum portion with a dimension equal to or less than 20 mm, more preferably of 0.1 to 10 mm. Also preferably, the shape includes a maximum portion having a dimension of 0.1 to 200 mm, especially 0.2 to 150 mm. Any appropriate shape may be selected. For example, the block may be machined into a plate or cylindrical shape.

Then a powder is disposed on a surface of the sintered magnet body. The powder contains at least 30% by weight of an alloy of $R^2{}_aT_bM_cA_dH_e$ wherein $R^2$ is at least one element selected from rare earth elements inclusive of Sc and Y, T is iron and/or cobalt, M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, A is boron and/or carbon, H is hydrogen, and "a" to "e" indicative of atomic percentages based on the alloy are in the range: $15 \leqq a \leqq 80$, $0.1 \leqq c \leqq 15$, $0 \leqq d \leqq 30$, $0 \leqq e \leqq (a \times 2.5)$, and the balance of b. The powder has an average particle size equal to or less than 100 μm. The magnet body with the powder on its surface is heat treated at a temperature equal to or below the sintering temperature of the magnet body in vacuum or in an inert gas such as Ar or He. This heat treatment is referred to as absorption treatment, hereinafter. The absorption treatment causes $R^2$ to be absorbed in the magnet body mainly through the grain boundary phase. Since $R^2$ being absorbed gives rise to substitution reaction with $R^1{}_2Fe_{14}B$ grains in proximity to grain boundaries, $R^2$ is preferably selected such that it does not reduce the magneto-crystalline anisotropy of $R^1{}_2Fe_{14}B$ grains. It is then preferred that at least one of Pr, Nd, Tb and Dy be predominant of $R^2$. The alloy may be prepared by melting metal or alloy feeds in vacuum or an inert gas atmosphere, preferably argon atmosphere, and casting the melt into a flat mold or book mold, melt quenching or strip casting. The alloy has a composition approximate to the liquid phase aid alloy in the above-described two-alloy process.

It is preferred that $R^2$ contain at least 10 atom % of at least one of Pr, Nd, Tb and Dy, more preferably at least 20 atom %, and even more preferably at least 40 atom % of at least one of Pr, Nd, Tb and Dy, and even up to 100 atom %.

The preferred range of a, c, d, and e is $15 \leqq a \leqq 70$, $0.1 \leqq c \leqq 10$, $0 \leqq d \leqq 15$, and $0 \leqq e \leqq (a \times 2.3)$, and more preferably $20 \leqq a \leqq 50$, $0.2 \leqq c \leqq 8$, $0.5 \leqq d \leqq 12$, and $0.1 \leqq e \leqq (a \times 2.1)$. Herein, b is preferably from 10 to 90, more preferably from 15 to 80, even more preferably from 15 to 75. T is iron (Fe) and/or cobalt (Co) while the content of Fe is preferably 30 to 70 atom %, especially 40 to 60 atom % based on T. A is boron (B) and/or carbon (C) while the content of boron is preferably 80 to 100 atom %, especially 90 to 99 atom % based on A.

The alloy of $R^2{}_aT_bM_cA_dH_e$ is generally crushed to a size of 0.05 to 3 mm, especially 0.05 to 1.5 mm. The crushing step uses a Brown mill or hydriding pulverization, with the hydriding pulverization being preferred for those alloys as strip cast. The coarse powder is then finely divided, for example, by a jet mill using nitrogen under pressure. For the reason that the smaller the particle size of the powder, the higher becomes the absorption efficiency, the fine powder preferably has a particle size equal to or less than 500 μm, more preferably equal to or less than 300 μm, and even more preferably equal to or less than 100 μm. The lower limit of particle size is preferably equal to or more than 0.1 μm, more preferably equal to or more than 0.5 μm though not particularly restrictive. It is noted that the average particle size is determined as a weight average diameter $D_{50}$ (particle diameter at 50% by weight cumulative, or median diameter) upon measurement of particle size distribution by laser diffractometry.

The powder contains at least 30% by weight, especially at least 60% by weight of the alloy, with even 100% by weight being acceptable, while the powder may contain at least one of an oxide of $R^3$, a fluoride of $R^4$, and an oxyfluoride of $R^5$ in addition to the alloy. Herein $R^3$, $R^4$, and $R^5$ are selected from rare earth elements inclusive of Sc and Y, with illustrative examples of $R^3$, $R^4$, and $R^5$ being the same as $R^1$.

The oxide of $R^3$, fluoride of $R^4$, and oxyfluoride of $R^5$ used herein are typically $R^3{}_2O_3$, $R^4F_3$, and $R^5OF$, respectively. They generally refer to oxides containing $R^3$ and oxygen, fluorides containing $R^4$ and fluorine, and oxyfluorides containing $R^5$, oxygen and fluorine, including $R^3O_n$, $R^4F_n$, and $R^5O_mF_n$ wherein m and n are arbitrary positive numbers, and modified forms in which part of $R^3$, $R^4$ or $R^5$ is substituted or stabilized with another metal element as long as they can achieve the benefits of the invention.

It is preferred that each of $R^3$, $R^4$, and $R^5$ contain at least 10 atom %, more preferably at least 20 atom % of at least one of Pr, Nd, Tb and Dy, and even up to 100 atom %.

Preferably the oxide of $R^3$, fluoride of $R^4$, and oxyfluoride of $R^5$ have an average particle size equal to or less than 100 μm, more preferably 0.001 to 50 μm, and even more preferably 0.01 to 10 μm.

The content of the oxide of $R^3$, fluoride of $R^4$, and oxyfluoride of $R^5$ is preferably at least 0.1% by weight, more preferably 0.1 to 50% by weight, and even more preferably 0.5 to 25% by weight based on the powder.

If necessary, boron, boron nitride, silicon or carbon in microparticulate form or an organic compound such as stearic acid may be added to the powder for the purposes of improving the dispersibility or enhancing the chemical and physical adsorption of the powder particles.

For the reason that a more amount of R is absorbed as the filling factor of the powder in the magnet surface-surrounding space is higher, the filling factor should be at least 10% by volume, preferably at least 40% by volume, calculated as an average value in the magnet surrounding space from the magnet surface to a distance equal to or less than 1 mm, in order for the invention to attain its effect. The upper limit of filling factor is generally equal to or less than 95% by volume, and especially equal to or less than 90% by volume, though not particularly restrictive.

One exemplary technique of disposing or applying the powder is by dispersing the powder in water or an organic solvent to form a slurry, immersing the magnet body in the slurry, and drying in hot air or in vacuum or drying in the ambient air. Alternatively, the powder can be applied by spray coating or the like. Any such technique is characterized by ease of application and mass treatment. Specifically the slurry contains the powder in a concentration of 1 to 90% by weight, more specifically 5 to 70% by weight.

The temperature of absorption treatment is equal to or below the sintering temperature of the magnet body. The treatment temperature is limited for the following reason. If treatment is done at a temperature above the sintering temperature (designated Ts in ° C.) of the relevant sintered magnet, there arise problems like (1) the sintered magnet alters its structure and fails to provide excellent magnetic properties; (2) the sintered magnet fails to maintain its dimensions as worked due to thermal deformation; and (3) the diffusing R can diffuse into the interior of magnet grains beyond the grain boundaries in the magnet, resulting in a reduced remanence. The treatment temperature should thus be equal to or below the sintering temperature, and preferably equal to or below (Ts−10)° C. The lower limit of temperature is preferably at least 210° C., more preferably at least 360° C. The time of absorption treatment is from 1 minute to 10 hours. The absorption treatment is not completed within less than 1 minutes whereas more than 10 hours of treatment gives rise to the problems that the sintered magnet alters its structure and the inevitable oxidation and evaporation of components adversely affect the magnetic properties. The more preferred time is 5 minutes to 8 hours, especially 10 minutes to 6 hours.

Also preferably, the absorption treatment is followed by aging treatment. The aging treatment is desirably at a temperature which is below the absorption treatment temperature, preferably from 200° C. to a temperature lower than the absorption treatment temperature by 10° C., and more preferably from 350° C. to a temperature lower than the absorption treatment temperature by 10° C. The atmosphere is preferably vacuum or an inert gas such as Ar or He. The time of aging treatment is from 1 minute to 10 hours, preferably from 10 minutes to 5 hours, and more preferably from 30 minutes to 2 hours.

It is noted for the machining of the sintered magnet body that if the coolant used in the machining tool is aqueous, or if the surface being machined is exposed to high temperature during the machining, there is a likelihood of an oxide layer forming on the machined surface, which oxide layer can inhibit the absorption reaction of R component from the powder deposit to the magnet body. In such a case, the oxide layer is removed by washing with at least one of alkalis, acids and organic solvents or by shot blasting before adequate absorption treatment is carried out. That is, the sintered magnet body machined to the predetermined shape is washed with at least one agent of alkalis, acids and organic solvents or shot blasted for removing a surface affected layer therefrom before the absorption treatment is carried out.

Also, after the absorption treatment or after the aging treatment, the sintered magnet body may be washed with at least one agent selected from alkalis, acids and organic solvents, or machined again. Alternatively, plating or paint coating may be carried out after the absorption treatment, after the aging treatment, after the washing step, or after the machining step following the absorption treatment.

Suitable alkalis which can be used herein include potassium pyrophosphate, sodium pyrophosphate, potassium citrate, sodium citrate, potassium acetate, sodium acetate, potassium oxalate, sodium oxalate, etc.; suitable acids include hydrochloric acid, nitric acid, sulfuric acid, acetic acid, citric acid, tartaric acid, etc.; and suitable organic solvents include acetone, methanol, ethanol, isopropyl alcohol, etc. In the washing step, the alkali or acid may be used as an aqueous solution with a suitable concentration not attacking the magnet body.

The above-described washing, shot blasting, machining, plating, and coating steps may be carried out by standard techniques.

The permanent magnet material of the invention can be used as high-performance permanent magnets.

EXAMPLE

Examples and Comparative Examples are given below for further illustrating the invention although the invention is not limited thereto. In Examples, the filling factor of alloy powder in the magnet surface-surrounding space is calculated from a dimensional change and weight gain of the magnet after powder treatment and the true density of powder material.

Example 1 and Comparative Example 1

An alloy in thin plate form was prepared by a strip casting technique, specifically by weighing predetermined amounts of Nd, Al, Fe and Cu metals having a purity of at least 99% by weight and ferroboron, high-frequency heating in an argon atmosphere for melting, and casting the alloy melt on a copper single roll. The resulting alloy had a composition of 14.5 atom % Nd, 0.5 atom % Al, 0.3 atom % Cu, 5.8 atom % B, and the balance of Fe. The alloy was exposed to hydrogen gas at 0.11 MPa and room temperature for hydriding and then heated up to 500° C. for partial dehydriding while evacuating to vacuum. The hydriding pulverization was followed by cooling and sieving, obtaining a coarse powder under 50 mesh.

On a jet mill using high-pressure nitrogen gas, the coarse powder was finely pulverized to a mass median particle diameter of 4.9 μm. The fine powder was compacted in a nitrogen atmosphere under a pressure of about 1 ton/cm$^2$ while being oriented in a magnetic field of 15 kOe. The green compact was then placed in a sintering furnace in an argon atmosphere where it was sintered at 1,060° C. for 2 hours, obtaining a magnet block. Using a diamond cutter, the magnet block was machined on all the surfaces to dimensions of 50 mm ×20 mm×2 mm (thick). It was successively washed with alkaline solution, deionized water, nitric acid, and deionized water, and dried.

Another alloy in thin plate form was prepared by a strip casting technique, specifically by weighing predetermined amounts of Nd, Dy, Al, Fe, Co and Cu metals having a purity of at least 99% by weight and ferroboron, high-frequency heating in an argon atmosphere for melting, and casting the alloy melt on a copper single roll. The resulting alloy had a composition of 15.0 atom % Nd, 15.0 atom % Dy, 1.0 atom % Al, 2.0 atom % Cu, 6.0 atom % B, 20.0 atom % Fe, and the balance of Co. The alloy was milled on a disc mill in a nitrogen atmosphere into a coarse powder under 50 mesh. On a jet mill using high-pressure nitrogen gas, the coarse powder was finely pulverized to a mass median particle diameter of 8.4 μm. The fine powder thus obtained is designated alloy powder T1.

Subsequently, 100 g of alloy powder T1 was mixed with 100 g of ethanol to form a suspension, in which the magnet body was immersed for 60 seconds with ultrasonic waves being applied. The magnet body was pulled up and immediately dried with hot air. At this point, alloy powder T1 surrounded the magnet and occupied a space spaced from the magnet surface at an average distance of 56 μm at a filling factor of 30% by volume. The magnet body covered with alloy powder T1 was subjected to absorption treatment in an argon atmosphere at 800° C. for 8 hours, then to aging treatment at 500° C. for one hour, and quenched, obtaining a magnet body M1 within the scope of the invention. For comparison purposes, a magnet body P1 was prepared by subjecting the magnet body to only heat treatment without powder coverage.

Magnet bodies M1 and P1 were measured for magnetic properties, which are shown in Table 1. As compared with magnet body P1, magnet body M1 within the scope of the invention showed an increase of 183 kAm in coercive force and a drop of 15 mT in remanence.

TABLE 1

| | Designation | $B_r$ [T] | $H_{cJ}$ [kAm$^{-1}$] | $(BH)_{max}$ [kJ/m$^3$] |
|---|---|---|---|---|
| Example 1 | M1 | 1.390 | 1178 | 374 |
| Comparative Example 1 | P1 | 1.405 | 995 | 381 |

Example 2 and Comparative Example 2

An alloy in thin plate form was prepared by a strip casting technique, specifically by weighing predetermined amounts of Nd, Al and Fe metals having a purity of at least 99% by weight and ferroboron, high-frequency heating in an argon atmosphere for melting, and casting the alloy melt on a copper single roll. The resulting alloy had a composition of 13.5 atom % Nd, 0.5 atom % Al, 6.0 atom % B, and the balance of Fe. The alloy was exposed to hydrogen gas at 0.11 MPa and room temperature for hydriding and then heated up to 500° C. for partial dehydriding while evacuating to vacuum. The hydriding pulverization was followed by cooling and sieving, obtaining a coarse powder under 50 mesh (designated alloy powder A).

Another alloy was prepared by weighing predetermined amounts of Nd, Dy, Fe, Co, Al and Cu metals having a purity of at least 99% by weight and ferroboron, high-frequency heating in an argon atmosphere for melting, and casting in a flat mold. The resulting ingot had a composition of 20 atom % Nd, 10 atom % Dy, 24 atom % of Fe, 6 atom % B, 1 atom % Al, 2 atom % Cu, and the balance of Co. The ingot was crushed on a jaw crusher and a Brown mill in a nitrogen atmosphere, followed by sieving, obtaining a coarse powder under 50 mesh (designated alloy powder B).

Subsequently, alloy powders A and B were weighed in amounts of 90% and 10% by weight, respectively, and mixed together on a V blender for 30 minutes. On a jet mill using high-pressure nitrogen gas, the mixed powder was finely pulverized to a mass median particle diameter of 4.3 μm. The mixed fine powder was compacted in a nitrogen atmosphere under a pressure of about 1 ton/cm$^2$ while being oriented in a magnetic field of 15 kOe. The green compact was then placed in a sintering furnace in an argon atmosphere where it was sintered at 1,060° C. for 2 hours, obtaining a magnet block. Using a diamond cutter, the magnet block was machined on all the surfaces to dimensions of 40 mm×12 mm×4 mm (thick). It was successively washed with alkaline solution, deionized water, nitric acid, and deionized water, and dried.

Another alloy in thin plate form was prepared by a strip casting technique, specifically by weighing predetermined amounts of Nd, Dy, Al, Fe, Co and Cu metals having a purity of at least 99% by weight, ferroboron and retort carbon, high-frequency heating in an argon atmosphere for melting, and casting the alloy melt on a copper single roll. The resulting alloy had a composition of 10.0 atom % Nd, 20.0 atom % Dy, 1.0 atom % Al, 1.0 atom % Cu, 5.0 atom % B, 1.0 atom % C, 15.0 atom % Fe, and the balance of Co. The alloy was milled on a disc mill in a nitrogen atmosphere into a coarse powder under 50 mesh. On a jet mill using high-pressure nitrogen gas, the coarse powder was finely pulverized to a mass median particle diameter of 6.7 μm. The fine powder thus obtained is designated alloy powder T2.

Subsequently, 100 g of alloy powder T2 was mixed with 100 g of ethanol to form a suspension, in which the magnet body was immersed for 60 seconds with ultrasonic waves being applied. The magnet body was pulled up and immediately dried with hot air. At this point, alloy powder T2 surrounded the magnet and occupied a space spaced from the magnet surface at an average distance of 100 μm at a filling factor of 25% by volume. The magnet body covered with alloy powder T2 was subjected to absorption treatment in an argon atmosphere at 850° C. for 15 hours, then to aging treatment at 510° C. for one hour, and quenched, obtaining a magnet body M2 within the scope of the invention. For comparison purposes, a magnet body P2 was prepared by subjecting the magnet body to only heat treatment without powder coverage.

Magnet bodies M2 and P2 were measured for magnetic properties, which are shown in Table 2. As compared with magnet body P2, magnet body M2 within the scope of the invention showed an increase of 167 kAm in coercive force and a drop of 13 mT in remanence.

TABLE 2

| | Designation | $B_r$ [T] | $H_{cJ}$ [kAm$^{-1}$] | $(BH)_{max}$ [kJ/m$^3$] |
|---|---|---|---|---|
| Example 2 | M2 | 1.399 | 1297 | 378 |
| Comparative Example 2 | P2 | 1.412 | 1130 | 385 |

Example 3 and Comparative Example 3

An alloy in thin plate form was prepared by a strip casting technique, specifically by weighing predetermined amounts of Nd, Pr, Al and Fe metals having a purity of at least 99% by weight and ferroboron, high-frequency heating in an argon atmosphere for melting, and casting the alloy melt on a copper single roll. The resulting alloy had a composition of 12.5 atom % Nd, 1.5 atom % Pr, 0.5 atom % Al, 5.8 atom % B, and the balance of Fe. The alloy was exposed to hydrogen gas at 0.11 MPa and room temperature for hydriding and then heated up to 500° C. for partial dehydriding while evacuating to vacuum. The hydriding pulverization was followed by cooling and sieving, obtaining a coarse powder under 50 mesh.

On a jet mill using high-pressure nitrogen gas, the coarse powder was finely pulverized to a mass median particle diameter of 4.4 μm. The fine powder was compacted in a nitrogen atmosphere under a pressure of about 1 ton/cm$^2$ while being oriented in a magnetic field of 15 kOe. The green compact was then placed in a sintering furnace in an argon atmosphere where it was sintered at 1,060° C. for 2 hours, obtaining a magnet block. Using a diamond cutter, the magnet block was machined on all the surfaces to dimensions of 50 mm ×50 mm×8 mm (thick). It was successively washed with alkaline solution, deionized water, nitric acid, and deionized water, and dried.

Another alloy in thin plate form was prepared by a strip casting technique, specifically by weighing predetermined amounts of Nd, Dy, Al, Fe, Co and Cu metals having a purity of at least 99% by weight and ferroboron, high-frequency heating in an argon atmosphere for melting, and casting the alloy melt on a copper single roll. The resulting alloy had a composition of 10.0 atom % Nd, 20.0 atom % Dy, 1.0 atom % Al, 1.0 atom % Cu, 6.0 atom % B, 15.0 atom % Fe, and the balance of Co. The alloy was exposed to hydrogen gas at 0.11 MPa and room temperature for hydriding and then heated up to 350° C. for partial dehydriding while evacuating to vacuum. The hydriding pulverization was followed by cooling and sieving, obtaining a coarse powder under 50 mesh. It contained hydrogen in an atom ratio of 58 relative to 100 for the alloy, that is, a hydrogen content of 36.71 atom %. On a jet mill using high-pressure nitrogen gas, the coarse powder was finely pulverized to a mass median particle diameter of 4.2 μm. The fine powder thus obtained is designated alloy powder T3.

Subsequently, 100 g of alloy powder T3 was mixed with 100 g of isopropyl alcohol to form a suspension, in which the magnet body was immersed for 60 seconds with ultrasonic waves being applied. The magnet body was pulled up and immediately dried with hot air. At this point, alloy powder T3 surrounded the magnet and occupied a space spaced from the magnet surface at an average distance of 65 μm at a filling factor of 30% by volume. The magnet body covered with alloy powder T3 was subjected to absorption treatment in an argon atmosphere at 850° C. for 12 hours, then to aging treatment at 535° C. for one hour, and quenched, obtaining a magnet body M3 within the scope of the invention. For comparison purposes, a magnet body P3 was prepared by subjecting the magnet body to only heat treatment without powder coverage.

Magnet bodies M3 and P3 were measured for magnetic properties, which are shown in Table 3. As compared with magnet body P3, magnet body M3 within the scope of the invention showed an increase of 183 kAm in coercive force and a drop of 13 mT in remanence.

TABLE 3

| | Designation | $B_r$ [T] | $H_{cJ}$ [kAm$^{-1}$] | $(BH)_{max}$ [kJ/m$^3$] |
|---|---|---|---|---|
| Example 3 | M3 | 1.412 | 1225 | 386 |
| Comparative Example 3 | P3 | 1.425 | 1042 | 394 |

Example 4 and Comparative Example 4

An alloy in thin plate form was prepared by a strip casting technique, specifically by weighing predetermined amounts of Nd, Al and Fe metals having a purity of at least 99% by weight and ferroboron, high-frequency heating in an argon atmosphere for melting, and casting the alloy melt on a copper single roll. The resulting alloy had a composition of 13.5 atom % Nd, 0.5 atom % Al, 6.0 atom % B, and the balance of Fe. The alloy was exposed to hydrogen gas at 0.11 MPa and room temperature for hydriding and then heated up to 500° C. for partial dehydriding while evacuating to vacuum. The hydriding pulverization was followed by cooling and sieving, obtaining a coarse powder under 50 mesh (designated alloy powder C).

Another alloy was prepared by weighing predetermined amounts of Nd, Dy, Fe, Co, Al and Cu metals having a purity of at least 99% by weight and ferroboron, high-frequency heating in an argon atmosphere for melting, and casting in a flat mold. The resulting ingot had a composition of 20 atom % Nd, 10 atom % Dy, 24 atom % Fe, 6 atom % B, 1 atom % Al, 2 atom % Cu, and the balance of Co. The ingot was crushed on a jaw crusher and a Brown mill in a nitrogen atmosphere, followed by sieving, obtaining a coarse powder under 50 mesh (designated alloy powder D).

Subsequently, alloy powders C and D were weighed in amounts of 90% and 10% by weight, respectively, and mixed together on a V blender for 30 minutes. On a jet mill using high-pressure nitrogen gas, the mixed powder was finely pulverized to a mass median particle diameter of 5.2 μm. The mixed fine powder was compacted in a nitrogen atmosphere under a pressure of about 1 ton/cm$^2$ while being oriented in a magnetic field of 15 kOe. The green compact was then placed in a sintering furnace in an argon atmosphere where it was sintered at 1,060° C. for 2 hours, obtaining a magnet block. Using a diamond cutter, the magnet block was machined on all the surfaces to dimensions of 40 mm×12 mm×4 mm (thick). It was successively washed with alkaline solution, deionized water, nitric acid, and deionized water, and dried.

Another alloy in thin plate form was prepared by a strip casting technique, specifically by weighing predetermined amounts of Nd, Dy, Al, Fe, Co and Cu metals having a purity of at least 99% by weight and ferroboron, high-frequency heating in an argon atmosphere for melting, and casting the alloy melt on a copper single roll. The resulting alloy had a composition of 10.0 atom % Nd, 20.0 atom % Dy, 1.0 atom % Al, 1.0 atom % Cu, 6.0 atom % B, 15.0 atom % Fe, and the balance of Co. The alloy was milled on a disc mill in a nitrogen atmosphere into a coarse powder under 50 mesh. On a jet mill using high-pressure nitrogen gas, the coarse powder was finely pulverized to a mass median particle diameter of 8.4 μm. The fine powder thus obtained is designated alloy powder T4.

Subsequently, 70 g of alloy powder T4 was mixed with 30 g of dysprosium fluoride and 100 g of ethanol to form a suspension, in which the magnet body was immersed for 60 seconds with ultrasonic waves being applied. Note that the dysprosium fluoride powder had an average particle size of 2.4 μm. The magnet body was pulled up and immediately dried with hot air. At this point, alloy powder T4 surrounded the magnet and occupied a space spaced from the magnet surface at an average distance of 215 μm at a filling factor of 15% by volume. The magnet body covered with alloy powder T4 and dysprosium fluoride powder was subjected to absorption treatment in an argon atmosphere at 825° C. for 10 hours, then to aging treatment at 500° C. for one hour, and quenched, obtaining a magnet body M4 within the scope of the invention. For comparison purposes, a magnet body P4 was prepared by subjecting the magnet body to only heat treatment without powder coverage.

Magnet bodies M4 and P4 were measured for magnetic properties, which are shown in Table 4. As compared with magnet body P4, magnet body M4 within the scope of the invention showed an increase of 294 kAm in coercive force and a drop of 15 mT in remanence.

TABLE 4

| | Designation | $B_r$ [T] | $H_{cJ}$ [kAm$^{-1}$] | $(BH)_{max}$ [kJ/m$^3$] |
|---|---|---|---|---|
| Example 4 | M4 | 1.397 | 1424 | 378 |
| Comparative Example 4 | P4 | 1.412 | 1130 | 386 |

Examples 5 to 18 and Comparative Example 5

An alloy in thin plate form was prepared by a strip casting technique, specifically by weighing predetermined amounts of Nd, Al, Fe and Cu metals having a purity of at least 99% by weight and ferroboron, high-frequency heating in an argon atmosphere for melting, and casting the alloy melt on a copper single roll. The resulting alloy had a composition of 14.5 atom % Nd, 0.5 atom % Al, 0.3 atom % Cu, 5.8 atom % B, and the balance of Fe. The alloy was exposed to hydrogen gas at 0.11 MPa and room temperature for hydriding and then heated up to 500° C. for partial dehydriding while evacuating to vacuum. The hydriding pulverization was followed by cooling and sieving, obtaining a coarse powder under 50 mesh.

On a jet mill using high-pressure nitrogen gas, the coarse powder was finely pulverized to a mass median particle diameter of 4.5 μm. The fine powder was compacted in a nitrogen atmosphere under a pressure of about 1 ton/cm$^2$ while being oriented in a magnetic field of 15 kOe. The green compact was then placed in a sintering furnace in an argon atmosphere where it was sintered at 1,060° C. for 2 hours, obtaining a magnet block. Using a diamond cutter, the magnet block was machined on all the surfaces to dimensions of 5 mm ×5 mm×2.5 mm (thick). It was successively washed with alkaline solution, deionized water, citric acid, and deionized water, and dried.

Another alloy in thin plate form was prepared by a strip casting technique, specifically by weighing predetermined amounts of Nd, Dy, Al, Fe, Co, Cu, Si, Ti, V, Cr, Mn, Ni, Ga, Ge, Zr, Nb, Mo, Hf, Ta and W metals having a purity of at least 99% by weight and ferroboron, high-frequency heating in an argon atmosphere for melting, and casting the alloy melt on a copper single roll. The resulting alloy had a composition of 15.0 atom % Nd, 15.0 atom % Dy, 1.0 atom % Al, 2.0 atom % Cu, 6.0 atom % B, 2.0 atom % E (=Si, Ti, V, Cr, Mn, Ni, Ga, Ge, Zr, Nb, Mo, Hf, Ta or W), 20.0 atom % Fe, and the balance of Co. The alloy was milled on a disc mill in a nitrogen atmosphere into a coarse powder under 50 mesh. On a jet mill using high-pressure nitrogen gas, the coarse powder was finely pulverized to a mass median particle diameter of 8.0-8.8 μm. The fine powder thus obtained is designated alloy powder T5.

Subsequently, 100 g of alloy powder T5 was mixed with 100 g of ethanol to form a suspension, in which the magnet body was immersed for 60 seconds with ultrasonic waves being applied. The magnet body was pulled up and immediately dried with hot air. At this point, alloy powder T5 surrounded the magnet and occupied a space spaced from the magnet surface at an average distance of 83 to 97 μm at a filling factor of 25 to 35% by volume.

The magnet body covered with alloy powder T5 was subjected to absorption treatment in an argon atmosphere at 800° C. for 8 hours, then to aging treatment at 490 to 510° C. for one hour, and quenched, obtaining a magnet body within the scope of the invention. The magnet bodies are designated M5-1 to M5-14 corresponding to the additive element (in the alloy powder) E=Si, Ti, V, Cr, Mn, Ni, Ga, Ge, Zr, Nb, Mo, Hf, Ta and W. For comparison purposes, a magnet body P5 was prepared by subjecting the magnet body to only heat treatment without powder coverage.

Magnet bodies M5-1 to M5-14 and P5 were measured for magnetic properties, which are shown in Table 5. As compared with magnet body P5, magnet bodies M5-1 to M5-14 within the scope of the invention showed an increase of 170 kAm or more in coercive force and a drop of 33 mT or less in remanence.

TABLE 5

| | Designation | $B_r$ [T] | $H_{cJ}$ [$kAm^{-1}$] | $(BH)_{max}$ [$kJ/m^3$] |
|---|---|---|---|---|
| Example 5 | M5-1 | 1.400 | 1194 | 379 |
| Example 6 | M5-2 | 1.388 | 1180 | 373 |
| Example 7 | M5-3 | 1.390 | 1210 | 373 |
| Example 8 | M5-4 | 1.389 | 1238 | 373 |
| Example 9 | M5-5 | 1.382 | 1165 | 369 |
| Example 10 | M5-6 | 1.380 | 1179 | 369 |
| Example 11 | M5-7 | 1.378 | 1290 | 368 |
| Example 12 | M5-8 | 1.398 | 1206 | 378 |
| Example 13 | M5-9 | 1.400 | 1177 | 379 |
| Example 14 | M5-10 | 1.387 | 1186 | 372 |
| Example 15 | M5-11 | 1.372 | 1202 | 365 |
| Example 16 | M5-12 | 1.382 | 1178 | 369 |
| Example 17 | M5-13 | 1.372 | 1174 | 364 |
| Example 18 | M5-14 | 1.378 | 1183 | 367 |
| Comparative Example 5 | P5 | 1.405 | 995 | 383 |

Examples 19 to 22

The magnet body M1 of 50 mm×20 mm×2 mm (thick) in Example 1 was washed with 0.5N nitric acid for 2 minutes, rinsed with deionized water, and immediately dried with hot air. This magnet body within the scope of the invention is designated M6. Separately, the 50×20 mm surface of magnet body M1 was machined by means of a surface grinding machine, obtaining a magnet body of 50 mm×20 mm×1.6 mm (thick). This magnet body within the scope of the invention is designated M7. The magnet bodies M7 were subjected to epoxy coating and copper/nickel electroplating, obtaining magnet bodies M8 and M9, respectively, which are also within the scope of the invention.

Magnet bodies M6 to M9 were measured for magnetic properties, which are shown in Table 6. All magnet bodies exhibit excellent magnetic properties.

TABLE 6

| | Designation | $B_r$ [T] | $H_{cJ}$ [$kAm^{-1}$] | $(BH)_{max}$ [$kJ/m^3$] |
|---|---|---|---|---|
| Example 19 | M6 | 1.395 | 1180 | 376 |
| Example 20 | M7 | 1.385 | 1178 | 370 |
| Example 21 | M8 | 1.387 | 1176 | 371 |
| Example 22 | M9 | 1.385 | 1179 | 371 |

Japanese Patent Application No. 2006-112382 is incorporated herein by reference.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A method for preparing a rare earth permanent magnet material, comprising the steps of:

disposing a powder on a surface of a sintered magnet body of $R^1$—Fe—B composition wherein $R^1$ is at least one element selected from rare earth elements inclusive of Sc and Y, said powder comprising at least 30% by weight of an alloy of $R^2{}_aT_bM_cA_dH_e$ wherein $R^2$ is at least one element selected from rare earth elements inclusive of Sc and Y, T is iron or iron and cobalt wherein the content of iron is 30 to 70 atom % based on T, M is at least one element selected from the group consisting of Al, Cu, Zn, In, Si, P, S, Ti, V, Cr, Mn, Ni, Ga, Ge, Zr, Nb, Mo, Pd, Ag, Cd, Sn, Sb, Hf, Ta, and W, A is boron and/or carbon, H is hydrogen, and "a" to "e" is representative of atomic percentages based on the alloy and the range of "a", "c", "d" and "e" is $15 \leqq a \leqq 70$, $0.1 \leqq c \leqq 10$, $0 \leqq d \leqq 12$, e=0, and the balance is b, and said powder having an average particle size equal to or less than 100 μm, heat treating the magnet body having the powder disposed on its surface at a temperature equal to or below the sintering temperature of the magnet body in vacuum or in an inert gas, for absorption treatment for causing $R^2$ and at least one of T, M and A in the powder to be absorbed in the magnet body, and effecting an aging treatment at a lower temperature after the absorption treatment.

2. The method of claim 1, wherein said powder is disposed on the magnet body surface in an amount corresponding to an average filling factor of at least 10% by volume in a magnet body-surrounding space at a distance equal to or less than 1 mm from the magnet body surface.

3. The method of claim 1, wherein said powder contains at least 1% by weight of at least one of an oxide of $R^3$, a fluoride of $R^4$, and an oxyfluoride of $R^5$ wherein each of $R^3$, $R^4$, and $R^5$ is at least one element selected from rare earth elements inclusive of Sc and Y, so that at least one of $R^3$, $R^4$, and $R^5$ is absorbed in the magnet body.

4. The method of claim 3, wherein each of $R^3$, $R^4$, and $R^5$ contains at least 10 atom % of at least one element selected from Nd, Pr, Dy, and Tb.

5. The method of claim 1, wherein $R^2$ contains at least 10 atom % of at least one element selected from Nd, Pr, Dy, and Tb.

6. The method of claim 1, wherein in the disposing step, the powder is fed as a slurry dispersed in an aqueous or organic solvent.

7. The method of claim 1, further comprising, prior to the disposing step, washing the magnet body with at least one agent selected from alkalis, acids, and organic solvents.

8. The method of claim 1, further comprising, prior to the disposing step, shot blasting the magnet body for removing a surface layer.

9. The method of claim 1, further comprising washing the magnet body with at least one agent selected from alkalis, acids, and organic solvents after the absorption treatment.

10. The method of claim 1, further comprising machining the magnet body after the absorption treatment.

11. The method of claim 1, further comprising plating or coating the magnet body after the absorption treatment.

12. The method of claim 1, further comprising washing the magnet body with at least one agent selected from alkalis, acids, and organic solvents after the aging treatment.

13. The method of claim 1, further comprising machining the magnet body after the aging treatment.

14. The method of claim 1, further comprising plating or coating the magnet body after the aging treatment.

15. The method of claim 12, further comprising plating or coating the magnet body after the alkali, acid or organic solvent washing step following the aging treatment.

16. The method of claim 13, further comprising plating or coating the magnet body after the machining step following the aging treatment.

17. The method of claim 1, further comprising, prior to the disposing step, machining the magnet body to form a plate shape.

18. The method of claim 1, further comprising, prior to the disposing step, machining the magnet body to form a cylindrical shape.

19. The method of claim 17, wherein a portion of the plate shape magnet body has a dimension of equal to or less than 20 mm.

20. The method of claim 18, wherein a portion of the cylindrical shape magnet body has a dimension of equal to or less than 20 mm.

* * * * *